United States Patent [19]

Ghahremani et al.

[11] Patent Number: 4,590,727

[45] Date of Patent: May 27, 1986

[54] REFLECTIVE INSULATION BLANKET WITH RETAINING CLIPS

[75] Inventors: A. Moayed Ghahremani, Gardena; E. Freel Singleton, Grand Terrace, both of Calif.

[73] Assignee: Foilpleat Insulation Company, Inc., Gardena, Calif.

[21] Appl. No.: 592,017

[22] PCT Filed: Aug. 9, 1982

[86] PCT No.: PCT/US82/01087

§ 371 Date: Mar. 15, 1984

§ 102(e) Date: Mar. 15, 1984

[87] PCT Pub. No.: WO84/00783

PCT Pub. Date: Mar. 1, 1984

[51] Int. Cl.[4] ..... E04B 2/00

[52] U.S. Cl. ..... 52/406; 52/222; 52/712

[58] Field of Search ..... 52/407, 406, 404, 222, 52/712

[56] References Cited

U.S. PATENT DOCUMENTS

| | | | |
|---|---|---|---|
| 1,651,539 | 12/1927 | Olson | 52/406 |
| 1,939,306 | 12/1933 | Leslie | 52/406 |
| 1,997,581 | 4/1935 | Heeren | 52/407 |
| 2,101,836 | 12/1937 | Benedict | 52/404 |
| 2,164,138 | 6/1939 | London | 52/407 |
| 2,251,585 | 3/1938 | Finck . | |
| 2,385,209 | 4/1943 | Joyce . | |
| 2,584,194 | 2/1952 | Drury | 52/406 |
| 2,739,703 | 12/1953 | Giles . | |
| 2,777,786 | 1/1957 | Schwartz | 52/406 |
| 2,786,004 | 8/1953 | Schwartz et al. . | |
| 2,879,554 | 3/1959 | Wheeler | 52/407 |
| 2,906,655 | 9/1955 | Blumenstein . | |
| 2,914,148 | 2/1958 | Bock . | |
| 3,164,230 | 9/1959 | Adams . | |
| 3,531,899 | 10/1970 | Bartlet | 52/222 |
| 4,189,882 | 2/1980 | Harrison | 52/222 |
| 4,255,910 | 3/1981 | Wendt . | |

FOREIGN PATENT DOCUMENTS

| | | | |
|---|---|---|---|
| 604209 | 8/1960 | Canada | 52/407 |
| 7614053 | 6/1978 | Netherlands . | |
| 925962 | 7/1958 | United Kingdom . | |
| 869718 | 5/1959 | United Kingdom . | |

*Primary Examiner*—Henry E. Raduazo

*Attorney, Agent, or Firm*—Marshall A. Lerner

[57] ABSTRACT

A reflective insulation blanket of folded flexible metal foil having dead air spaces between a principle member (20) and one or more outer members (22) and (24). The blanket being held apart in spaced relationship with one or more pairs of expanders (28) terminating with a mounting flange (26) at each end. A pair of retaining clips (36) cooperate with each other to hold the blanket in place against building structural members (30) and (32). Each clip having an elongated base (38) folded over upon itself (40) to provide a retaining section terminating with a pair of radial arcuate surfaces (42) and (48) with an angular abuttment point on the extreme end. The clips (36) embrace the structural members (30) and (32) at the leg and compressably engage and retain the mounting flange (26) of the blanket against the web of the building structural members.

4 Claims, 16 Drawing Figures

FIG. 2

REFLECTIVE INSULATION BLANKET WITH RETAINING CLIPS

TECHNICAL FIELD

This invention relates in general, to envelope type filler insulation with separable clip type fasteners for static structures. The invention more particularly relates to expansible multi-layered reflective foil supported between bays in structures with compressible retaining clips which secure the insulation to the flange of structural beams or members.

BACKGROUND ART

Previously, insulating material in the form of folded flexible metal foil blankets have been installed in building structures using wooden studs, beams or framing members attached with nails, staples, tacks, brads or the like.

Benedict in U.S. Pat. No. 2,101,836 discloses a tack for fastening insulating blankets to framing members with the ends of the blanket folded over for support. U.S. Pat. No. 2,251,585 of Finck likewise utilized tacks to attach a blanket to the studs with a marginal strip added by sewing, pasting etc. Giles, U.S. Pat. No. 2,739,703 employs adhesive, staples or the like to an overlapped section of insulation comprising of kraft paper treated with asphalt and metalized with heat reflective material. Nails are applied as fasteners by Schwartz et al, in U.S. Pat. No. 2,777,786 for fastening purposes. Wiser teaches the use of a tack to the outer panel members of the heat reflective sheet.

Fastening into wood surfaces of prior art is well known however, the need has existed for a simple device for use with metal structural members to attach easily and maintain tension of the insulation blanket between the span.

Joyce in U.S. Pat. No. 2,385,209 takes advantage of a clamp adapted to a beam, however the flange of the member is only engaged by the clamp itself without providing mounting surfaces contiguous with the web.

Williams in U.S. Pat. No. 925,962 issued in Great Britain uses a U-clip for flange mounting however, the flange of the clip, while in intimate contact with the web, lacks sufficient surface area to support insulating blankets. U.S. Pat. No. 3,164,230 of Adams uses a spring clip attached to a T-bar but again only limited surface contact is maintained.

For background purposes and as indicative of the art to which the invention relates reference may be made to the following patents:

U.S. Pat. No. 2,786,004—Schwartz, et al
U.S. Pat. No. 2,906,655—Blumenstein
U.S. Pat. No. 2,914,148—Bock
U.S. Pat. No. 4,255,910—Wendt (Netherlands)
U.S. Pat. No. 7,614,053—Alco (Great Britain)
U.S. Pat. No. 869,718 —United-Carr Fastener Corporation No prior art presently provides the combination of attaching reflective insulation blankets with retaining clips to static structural building members.

SUMMARY OF INVENTION

In the past, it has been difficult to effectively insulate metal industrial and agricultural buildings or the like since the roof and wall structure of such buildings do not necessarily utilize construction members to which insulation blankets can be readily attached. Such conventional buildings normally employ I-beam, Z-members or bars or other angle iron beams making it difficult to conveniently attach insulating blankets. More recently the rising costs of energy has made it desirable to insulate such large buildings as it has been shown that by using such insulation on the inside of the roof, up to 30 percent in fuel for heating and cooling these spaces can be saved.

Therefore, a long standing need has been present to provide suitable clips or fasteners which may be readily deployed to secure insulating blankets directly to such bars or beams so that the blankets are readially secured thereto.

The above problems and difficulties are obviated by the present invention in which it is among the primary objects to provide a pair of heat treated spring clips adapted to cooperate with each other in order to hold insulation blankets in place against construction members of different cross sections.

One important object allows the insulation and clips to be easily adapted to variable areas such as walls, floors, subfloors, roofs and ceiling providing a minimum number of configurations for size and space variations.

Another object provides safety provisions as all material is either fireproof, such as the metalic clips and aluminum foil, or flame retardant as in the treated kraft paper allowing safety and applicable building codes to be satisfied. Still another object of the present invention is the permanence of the structure as the insulation does not attract moisture causing deterioration nor is any carcinogenic agent used as in some prior building insulating material.

Yet another object provides an installation procedure that is simple, requires no special tools, and the blanket snaps into place when fully deployed, audiably indicating its position. The weight of the system allows use in conventional structures with no reinforcing or modification necessary. Transportation and storage is also eased as the blanket is folded and rolled and the blanket can be easily cut to length for installation with common shears.

A further object provides a vapor sealed dead air space with reflective surfaces when the open ends are folded and closed. It is well known that the use of reflective metal foil is a very effective barrier against the transmission of radiant heat when used in conjunction with a dead air space.

These and other objects and advantages of the present invention will become apparent from the subsequent detailed description of the preferred embodiment and the claims taken in conjunction with the accompanying drawings.

BEST MODE FOR CARRYING OUT THE INVENTION

Figure 1:
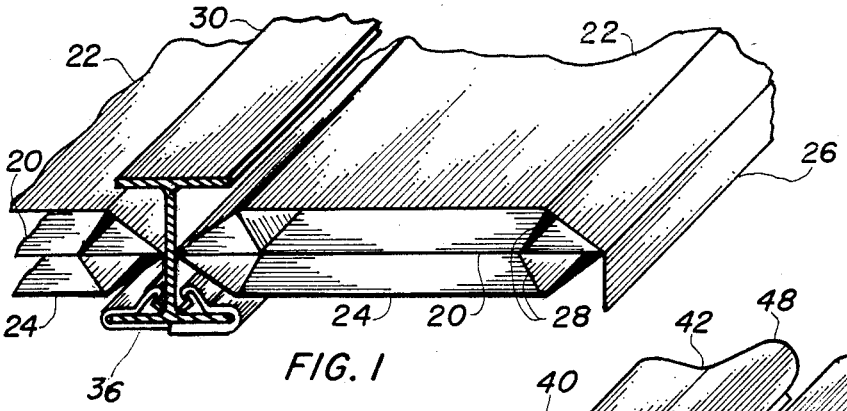
FIG. 1 is a partial isometric view of the preferred embodiment illustrating I-beam members in conjunction with the insulation blanket attached with separable clips.
Figure 2:
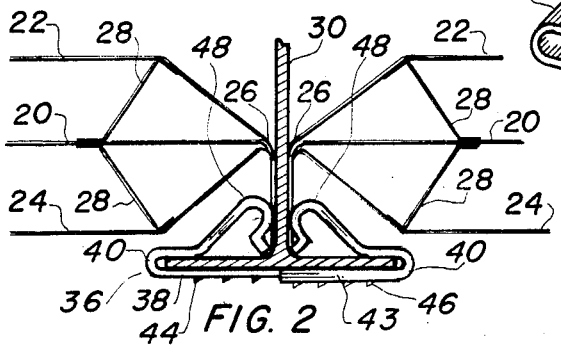
FIG. 2 is an elevation view of the preferred embodiment with separable clips and closable faced insulation.

Referring now more specifically to the referenced characters of the drawing, the invention in the preferred embodiment, best depicted in FIG. 1, utilizes an insulating blanket consisting of a principle reflective foil 20, with a surface that reflects on the outer part, tensioned between structural members of a building. The principle foil 20 is either composed of a single layer of aluminum or laminated kraft paper with aluminum foil on one or both sides. The principle foil 20 is folded for transportation and is opened with the creases being stretched flat when installed.

The aluminum foil is usually annealed to a "o" temper or dead soft varying in thickness from 0.00025 inches (0.006 mm) to 0.006 inches (0.152 mm). The kraft paper may be any suitable weight from 18 to 100 pounds (8 to 45 kilograms) base weight treated for fire retardancy and vermin or fungus resistance. An outer reflective foil 22 is juxtaposed with the principle foil 20 and is parallel in the central portion. Each end is secured to the principle foil 20 at the termination point however, the outer foil 22 is longer in length creating a bulge of material when tensioned flat. The material of the outer foil 22 is the same as that of the principle foil 20 with at least one reflective surface on the outside. A single embodiment with a pair of foils is depicted in FIGS. 4, 5, 10, 11, 15 and 16.

A second outer reflective foil 24 is attached to the primary foil 20 in like manner creating a double embodiment best illustrated in FIGS. 1, 2, 7, 8, 13 and 14. This second outer foil 24 is inversely opposed to the outer reflective foil 22 and is similar in all respects of of composition.

A mounting flange 26 is fixably positioned or secured between the principle foil 20 and the outer foils 22 and 24 at each end. The flange 26 may be any structural material such as metal, cloth, thermoplastic, cardboard with flame retardant chipboard being preferred. A certain amount of rigidity is required in the flange 26 maintaining integrity with the structural member and mounting clip.

A pair of expanders 28 are secured to the principle foil 20 on one end and the outer foil 22 and 24 on the other. These expanders 28 are positioned geometrically to each other near the ends of the foils 22 and 24 and mounting flanges 26. When the blanket is extended an air pocket is created between the principle foil 20 and outer foils 22 and 24. Also a secondary pocket is created between the expanders 28 and the same surfaces. All of the above elements are permanently bonded together at contiguous points with structural adhesive or the like making one composite blanket with a plurality of dead air spaces when stretched taut. The individual pleats necessary for rolling and transportation are eliminated when tension is applied to the mounting flanges 26.

In application the insulation blanket is installed between the flanges of building structural members in the form of I-beams 30 shown in FIGS. 1, 2, 4, and 5, Z-members 32 illustrated in FIGS. 7, 8, 10 and 11 or wood studs, beams, rafters, joints or the like 34 depicted in FIGS. 13 through 16.

Attachment to wooden members may be made by conventional attaching means such as nails, staples, tacks, screws, adhesive or the like or a combination thereof.

In all embodiments of the insulating blanket the reflective side of the foil is always on the outside surface allowing a maximum amount of reflectability to be utilized effectively reducing the transmission of heat therethrough.

The blanket is attached to the metalic building structural members at the web by holding the flange 26 tightly against the member. In the preferred embodiment that is accomplished by the use of a pair of clips 36 each consisting of an elongated base 38 with a U-shaped arcuate fold 40 on one end providing a pair of parallel surfaces continuing with an arcuate bearing surface 42 that is in intimate contact with the blanket and structural member 30, 32 or 34.

Figure 3:
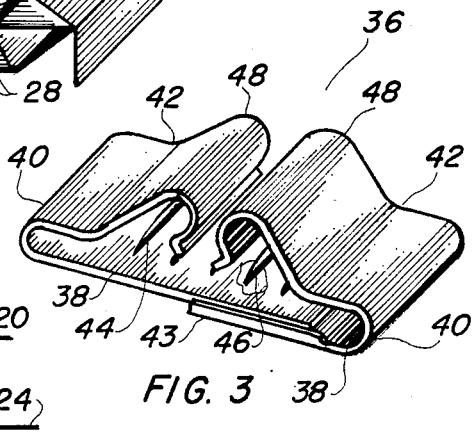
FIG. 3 is a partial isometric view of the preferred embodiment with the separable clip removed from the beam but positioned together.

Each clip 36 is resiliently biased and compressably embraces the mounting flange of the structural member 30, 32. The base 38 is contiguous with half of the lower external surface of the structural member leg with the U-shaped arcuate fold 40 contacting the upper surface of the leg maintaining the compressable engagement. This configuration of the clip 36 allows the insulation blanket flange 26 to be tensioned against the web of the structural member maintaining attachment when stretched between parallel structural members. In the preferred embodiment, best depicted in FIG. 3, the second clips 36 are in a pair containing at least two upwardly depending parallel side flanges 43 for insertably receiving the width of the first clip base 38, in the pair, holding them together in spaced relationship.

A plurality of spaced projections 44 are upset from the parent material on the underside of the first clip base in the pair. A plurality of parallel ribs 46 are also upset from the parent material on the top side of the second clip base and are adapted to register with the spaced projections 44 of the first clips. This arrangement maintains a tensioned relationship when assembled together on the building structural member.

A second arcuate portion 48 continues from the arcuate bearing surface 42 and is curved in reverse of the above surface 42. This portion 48 provides a rounded bearing surface to prevent tearing or creasing of the blanket and a downwardly depending outwardly projecting lip on the end thereof creates a second bearing area. This bearing area has a sharp edge and maintains compression between the blanket and the web of the building structural member 30 or 32 with consentrated linear force maintained through the spring action of the bend.

The clip 36 is constructed of a material having the characteristics of a high modulus of elasticity and yield strength such as spring steel or iron based alloys containing chromium as the major alloying constituent or any other substance having the structural integrity for the purpose.

Figure 4:
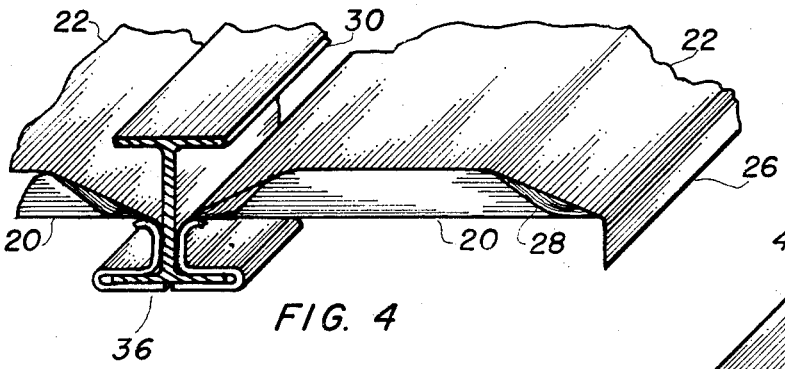
FIG. 4 is a partial isometric view of another embodiment illustrating I-beam members in conjunction with insulation attached with individual clips.
Figure 5:
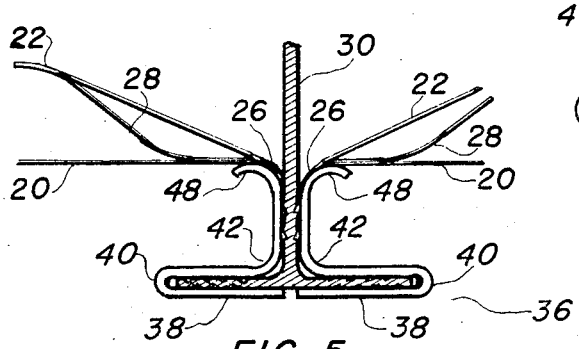
FIG. 5 is an elevation view of another embodiment as in FIG. 4 with individual clips and single insulation.
Figure 6:
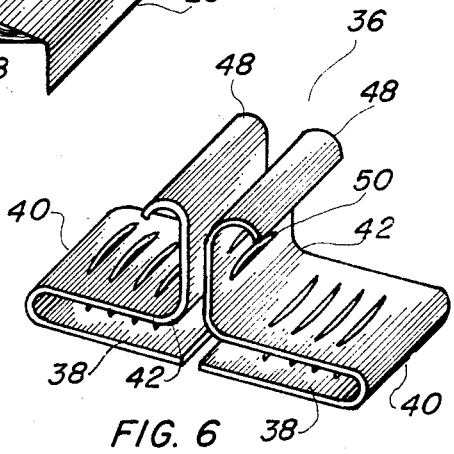
FIG. 6 is a partial isometric view of another embodiment with individual clips positioned plannar to each other.

In another embodiment best illustrated in FIG. 6 and shown installed in FIGS. 4 and 5 the clip 36 consists of two identical parts. Each part grips the leg or flange of the structural member 30 or 32 and act as pairs on opposite sides or may be used individually at the end of the run or with different structural shapes such as an angle or the like. The second arcuate bearing surface 42 is at right angles to the base 38 allowing continuous contact with the web of the structure 30 or 32. The clip further contains the means for securing the blanket to the member consisting of one or more outwardly projecting barbs 50 engaging the blanket mounting flange 26 into the member 30 or 32 in a piercing manner. This embodiment allows a single clip to be used near a right angle surface such as a wall or floor.

Figure 7:
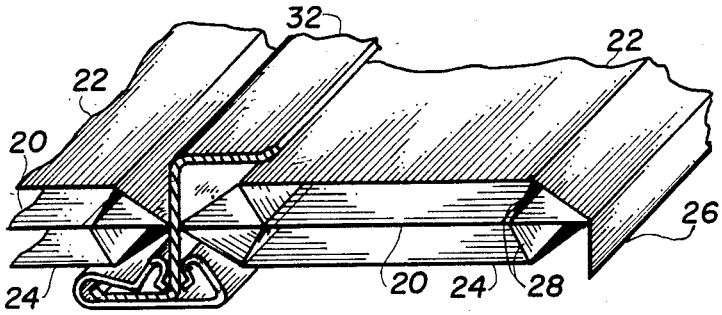
FIG. 7 is a partial isometric view of another embodiment illustrating Z-members in conjunction with the insulation blanket attached with a single clip.
Figure 8:
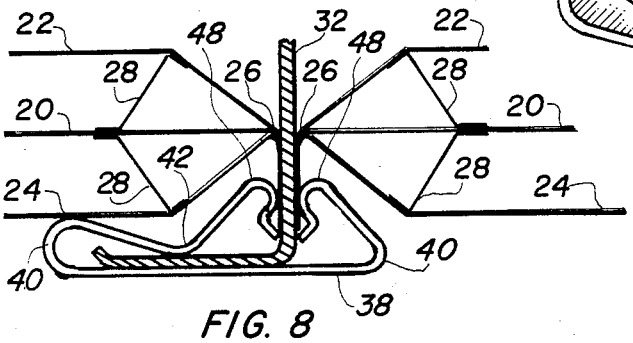
FIG. 8 is an elevation view of another embodiment as in FIG. 7 with a single clip and single insulation.
Figure 9:
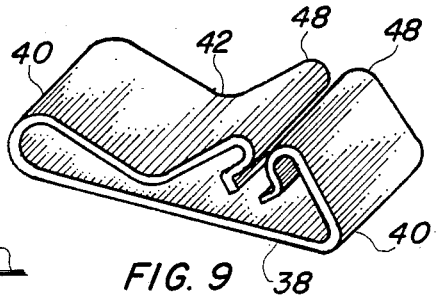
FIG. 9 is a partial isometric view of another embodiment comprising a single clip for use with a Z-member.

Another embodiment shown pictorally in FIG. 9 and illustrated installed in place with the blanket in FIGS. 7 and 8, utilizes a single one piece element. The base 38 has a pair of U-shaped arcuate folds 40 and an arcuate bearing surface 42 as well as a pair of second arcuate portions 48 with downwardly depending outwardly projecting lips. This clip is configured to correspond with building Z-members 32 having one longer portion encompassing the leg or flange of the member 32 and the other embracing the web on the opposite side only.

Figure 10:
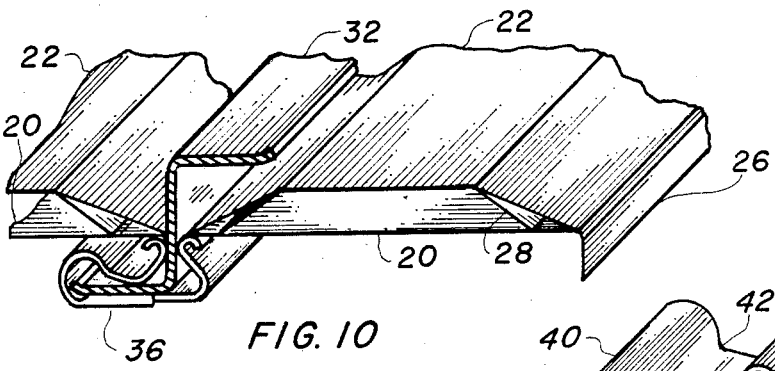
FIG. 10 is a partial isometric view of still another embodiment illustrating Z-members in conjunction with the insulation blanket attached with separable clips.
Figure 11:
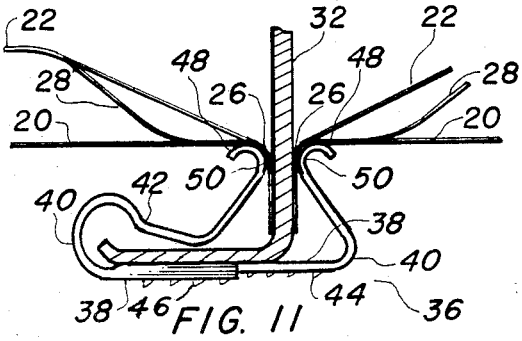
FIG. 11 is an elevation view of still another embodiment as in FIG. 10 with separable clips and single insulation.
Figure 12:
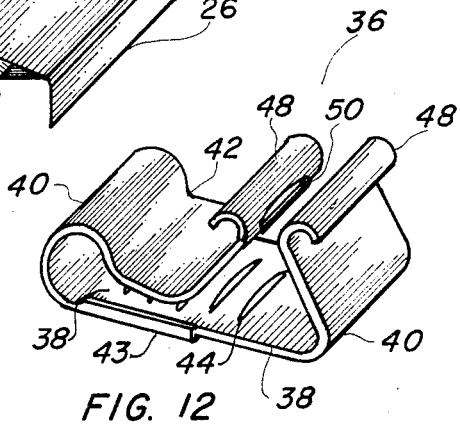
FIG. 12 is a partial isometric view of still another embodiment comprising a pair of separable clips for use with a Z-member.
Figure 13:
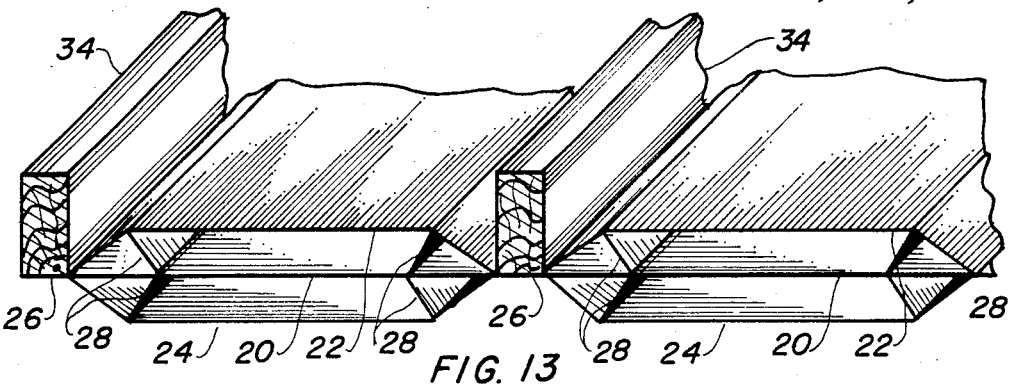
FIG. 13 is a partial isometric view of the double insulating blanket attached to a wood member.
Figure 14:
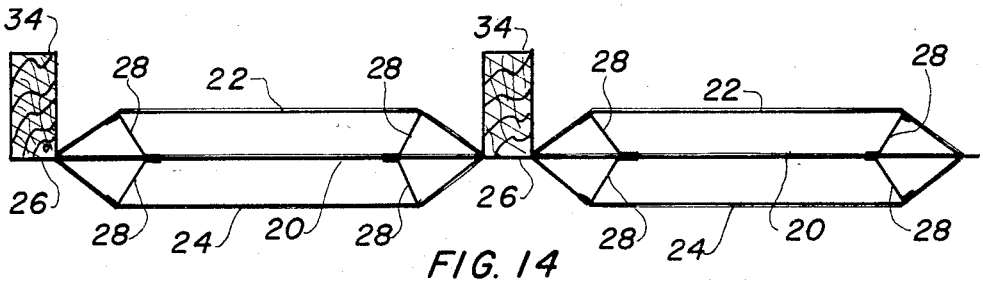
FIG. 14 is an elevation view of the double insulating blanket attached to a wood member.
Figure 15:
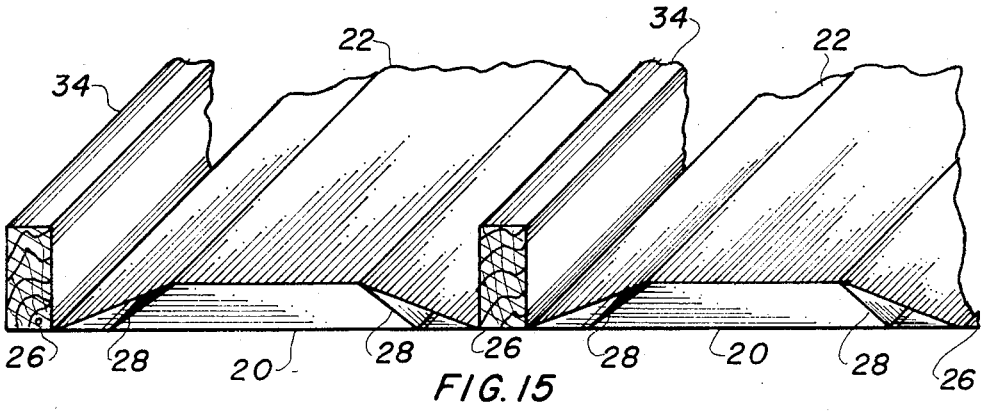
FIG. 15 is a partial isometric view of the single insulating blanket attached to a wood member.
Figure 16:
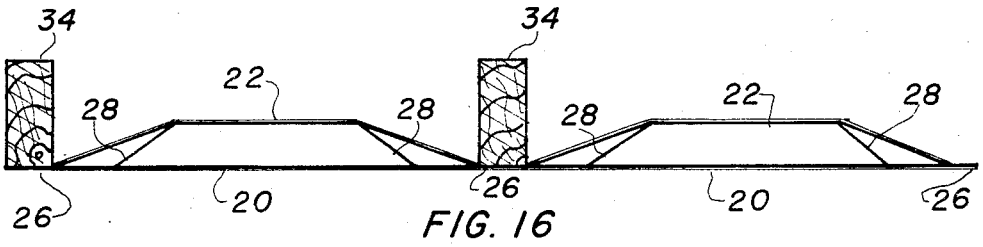
FIG. 16 is an elevation view of the single insulating ng blanket attached to a wood member.

A final embodiment incorporates the same mounting characteristics to a Z-member 32 and is shown in FIGS. 10, 11 and 12. This embodiment is in two separate pieces with the same basic form as above described for the Z-member 32 except the length of the base is not the same.

It can be seen that the performed insulation blankets may be readily installed in metal buildings employing I-beam, Z-bars or angle iron structural members by selecting one of the preceding four sets of retaining clips. In each instance, the clip halves are placed on opposite sides of the beam and slid together so that their respective bases engage while contact points engage respective flanges on opposite sides of the web of a particular structural member. The tension provided by the clip halves or mated portions holds the flanges of the respective insulation blankets in place against the web of the beam. Therefore, effective insulation for metal buildings, industrial and agricultural buildings can now be provided through the efficient use of this combination.

While the invention has been described in complete detail and pictorially shown in the accompanying drawings it is not to be limited to such details, since many changes and modifications may be made to the invention without departing from the spirit and scope thereof. Hence, it is described to cover any and all modifications and forms which may come within the language and scope of the claims.

We claim:

1. A reflective thermal insulating blanket with retaining clips mountable to flanges of building structural members, said thermal insulation blanket with retaining clips comprising the combination of:

a principal reflective foil having at least one outwardly reflective surface;

an outer reflective foil in parallel spaced relationship to said principal reflective foil to thereby create an air space therebetween;

expander means positioned between said principal reflective foil and said outer foil for securing them in their spaced relationship;

a mounting flange secured between said principal foil and said outer foil at the ends thereof for attachment to thereby provide a semi-rigid structural composite, said expander means being in close proximity to said mounting flange to thereby define a secondary air pocket between said principal reflective foil and said outer foil, whereby said principal reflective foil and said outer reflective foil provide thermal insulation to the building;

retaining clips means adapted to compressibly engage said mounting flange to at least one structural member of a building, said retaining clip means including a pair of elongated bases with the first of said pair having parallel side means and the second of said pair being formed to enable insertion of said elongated base of the second of said pair within said parallel side means of the first of said pair of elongated bases, and projecting barb means including at least one projecting barb formed on one of said pair of elongated bases, and at least one receiving rib formed on the other of said pair of elongated bases for engaging said one projecting barb means to mount the thermal insulation blanket to the building flange.

2. A reflective thermal insulating blanket with retaining clips mountable to flanges of building structural members, said thermal insulation blanket with retaining clips comprising the combination of:

a principal reflective foil having at least one outwardly reflective surface;

a first outer reflective foil in parallel spaced relationship to said principal reflective foil to thereby create an air space therebetween;

a second outer reflective foil positioned in parallel relationship with said principal reflective foil on the side of said principal reflective foil opposite to that on which said first outer reflective foil is juxtaposed, thereby creating a second dead air space between said second outer reflective foil and said principal reflective foil, and a mounting flange secured between said principal foil and said outer foil at the ends thereof for attachment to thereby provide a semi-rigid structural composite;

first expander means positioned between said principal reflective foil and said first outer reflective foil for securing them in their spaced relationship;

second expander means positioned between said principal reflective foil and said second outer reflective foil in close proximity to said mounting flange to thereby define another air pocket between said principal reflective foil and said second outer reflective foil;

said expander means being in close proximity to said mounting flange to thereby define a secondary air pocket between said principal foil and said outer foil, whereby said principal reflective foil, said outer reflective foil and said second outer reflective foil provide thermal insulation to the building;

retaining clips means adapted to compressibly engage said flange to at least one structural member of a building, said retaining clip means including a pair of elongated bases with the first of said pair having parallel side means and the second of said pair being formed to enable insertion of said within said parallel side means of the first of said pair of elongated bases, and projecting barb means including at least one projecting barb formed on one of said pair of elongated bases, and at least one parallel receiving rib formed on the other of said pair of elongated bases for engaging said one projecting barb means to mount the thermal insulation blanket to the building flange.

3. A retaining clip for holding a reflective thermal insulating blanket to a building structural member comprising;

a pair of elongated bases each having a U-shaped arcuate fold and a pair of parallel surfaces for providing resilient biasing to compressibility engage a flange of a building structural member, outwardly projecting barb means including at least one barb formed on the first of said pair of elongated bases, for engaging said reflective thermal insulation blanket said projecting barb means including at least one outwardly projecting barb formed on the first of said pair of elongated bases, and at least one receiving rib formed on the second of said bases adapted to register with said outwardly projecting barb to thereby provide a tension relationship between said first and second elongated bases to hold an insulating blanket to a building structural member.

4. The device as described in claim 3 and wherein the first of said elongated bases has a pair of parallel side means and the second of said pair of elongated bases is formed to enable insertion thereof within said parallel side means of the first said pair of elongated bases.

* * * * *